US005489912A

United States Patent [19]

Holloway

[11] Patent Number: 5,489,912

[45] Date of Patent: Feb. 6, 1996

[54] NON-RESONANT ANTENNA AND FEED APPARATUS THEREFOR

[75] Inventor: David J. Holloway, Anaheim, Calif.

[73] Assignee: Comant Industries, Inc., Santa Fe Springs, Calif.

[21] Appl. No.: 303,177

[22] Filed: Sep. 8, 1994

[51] Int. Cl.[6] ..... H01Q 9/00

[52] U.S. Cl. ..... 343/749; 343/722; 343/790; 343/830

[58] Field of Search ..... 343/705, 722, 343/749, 790, 791, 828, 829, 830, 831; H01Q 9/26

[56] References Cited

U.S. PATENT DOCUMENTS

| | | | |
|---|---|---|---|
| 2,284,434 | 5/1942 | Lindenblad | 343/790 |
| 4,779,098 | 10/1988 | Blene | 343/75 |
| 4,839,660 | 6/1989 | Hadzoglou | 343/745 X |
| 4,980,695 | 12/1990 | Blaese | 343/830 X |

*Primary Examiner*—Donald T. Hajec
*Assistant Examiner*—Tho Phan
*Attorney, Agent, or Firm*—Edward Dreyfus

[57] ABSTRACT

A monopole radiating blade antenna comprising a driving, high impedance stub mounted to the face of the blade that functions as part of the radiator as well as part of a shunt path between the blade and the base plate. The shunt path is completed by an air coil inductor connected between the center conductor of the stub and the base plate. One embodiment provides the input connector wire and stub in vertical alignment along the center vertical axis of the blade. Another embodiment arranges the stub to be off-set from the input wire. Some advantages over conventional blade antennas include increased gain at low angles of elevation above the horizon, good impedance match over a wide range of frequencies without using conventional ¼ wave length stub matching that can introduce dielectric losses, low resistance to ground to bleed off static electricity and lightning, non-loading of the high impedance path at design frequencies, and good accommodation of ⅝ wavelength radiator blade dimensioning.

14 Claims, 4 Drawing Sheets

NON-RESONANT ANTENNA AND FEED APPARATUS THEREFOR

BACKGROUND

The present invention relates to radiating blade antennas and more particularly to such antennas for use on aircraft and the like.

Conventional resonating monopole blade antennas for aircraft are known in a variety of designs and functions.

One class of such antennas includes a base plate, the latter serving as part of a ground plane structure. One such antenna 50 schematically shown in FIG. 4 includes the base plate 52, an input connector 54 mounted through the plate 52 through which extend ternfinal lug 56 and wire 58. A metal folded blade radiator 51 mounts vertically and above plate 52 on dielectric insulator 53. Lumped compensation members can be included in such an integrated matching stub 55 bonded to one face of blade 51 and having its outer end shorted to the blade face by a solder point and its other end connected to wire 58. The dimensions of the radiator legs and the stub are determined for the values they provide at the operating wavelength and the electrical values provided in accordance with well-known design principles. Ideally, coaxial stub length is selected to equal ¼ of the wavelength at the center frequency (taking into account the phase velocity of the stub material), in order to broaden the operating frequency band by effectively neutralizing bandlimiting radiation reactance. The impedance of said coaxial stub is chosen so as to maximize the effective antenna bandwidth in direct trade-off for a marginally degraded VSWR over the operating frequency band. The characteristic VSWR response is that of a second order Chebychev polynomial or Maximally Flat/Butterworth function.

Another standard radiating antenna is schematically shown in FIG. 5 that includes a base plate 62 and an input connector 64 mounted through plate 62. The vertically oriented metallic radiator blade 61 mounts above plate 62 on dielectric mounts or "standoffs" 68. The bare end of wire 66 is soldered to blade 61. In this configuration, no lumped elements are provided, except for the connecting wire 66, which has some value of intrinsic series inductance. Equivalent modeling of the blade will result in an equivalent lumped L.C.R. circuit topology and is embodied as part of the design characteristics.

The chief motivation for implementing such an antenna configuration of FIG. 5, instead of that shown on FIG. 4, is to exploit the condition that an antenna radiator taller than ¼ wavelength will have a different electromagnetic radiation pattern and gain value. With increased physical and electrical height, the radiated, or received, RF energy will tend to be biased at lower angles of elevation towards the horizon, with an increased gain. The inherent difficulty associated with this scheme is that the radiator is not a purely resonant structure at mid-band frequencies. Consequently, companion quarter wave stub matching methods are no longer appropriate for they would tend to interfere with the non-resonant radiator operation characteristics. This disadvantage is overcome by placing a rectangular slot in the base of the radiator so as to allow for the simultaneous combination of additional values of lumped series inductance in the form of wire 66 in FIG. 5, while reducing the undesirable distributed capacitance between the radiator and the base plate, near the connector feed point region.

SUMMARY OF EXEMPLARY EMBODIMENT OF INVENTION

The present invention provides a new monopole radiating blade antenna arrangement that contains the benefits of improved gain at lower radiation angles above the horizon, yet still provides for sufficiently wide operational bandwidth (due to its larger radiator size), and very good impedance matching characteristics (VSWR) across the frequency band of interest. Such an antenna according to the principles of the present invention comprises a base plate, an upstanding metallic radiator blade mounted above the plate, a high impedance shunt stub mounted to one face of the blade, and a wire or outer shield of a stub that functions as an inductor at the design frequency to couple RF energy to and from the radiator to the connector. A lumped RF air core choke inductor in series with the parallel stub is provided as an RF choke to minimize the loading-down influence of the stub on the radiator impedance. The blade is dimensioned so that it is non-resonating at the center design frequency wavelength. In one example, the blade comprises a ⅝ wavelength. The shunt stub is an electrically inert high impedance quarter-wave stub at mid-band frequencies with series choke inductor placed in combination with it to ground.

Some advantages resulting from the present invention include:

a) Benefit of increased gain at low angles of elevation above the horizon.

b) Ability to provide very good impedance match over relatively wide range of frequencies, without using conventional low impedance ¼ wave stub matching that can introduce dielectric losses into the antenna system.

c) Stub provides (i) a low resistance point to ground to help dissipate the build up of static electric charges on the radiator that could attract lightning charges, and (ii) a non-loading high impedance path, at design frequencies, so as to not interfere with radiator electrical characteristics.

d) Mechanical symmetry of antenna (i) is relatively easy to achieve, which usually results in more symmetrical radiation patterns, and reduced likelihood of induction of mechanical flutter in aviation applications, and (ii) enables reduced manufacturing costs.

DRAWINGS

Other and further advantages shall become apparent with the following detailed description of exemplary embodiments when taken in view of the appended drawings, in which.

DETAILED DESCRIPTION OF EXEMPLARY EMBODIMENTS

Figure 1:
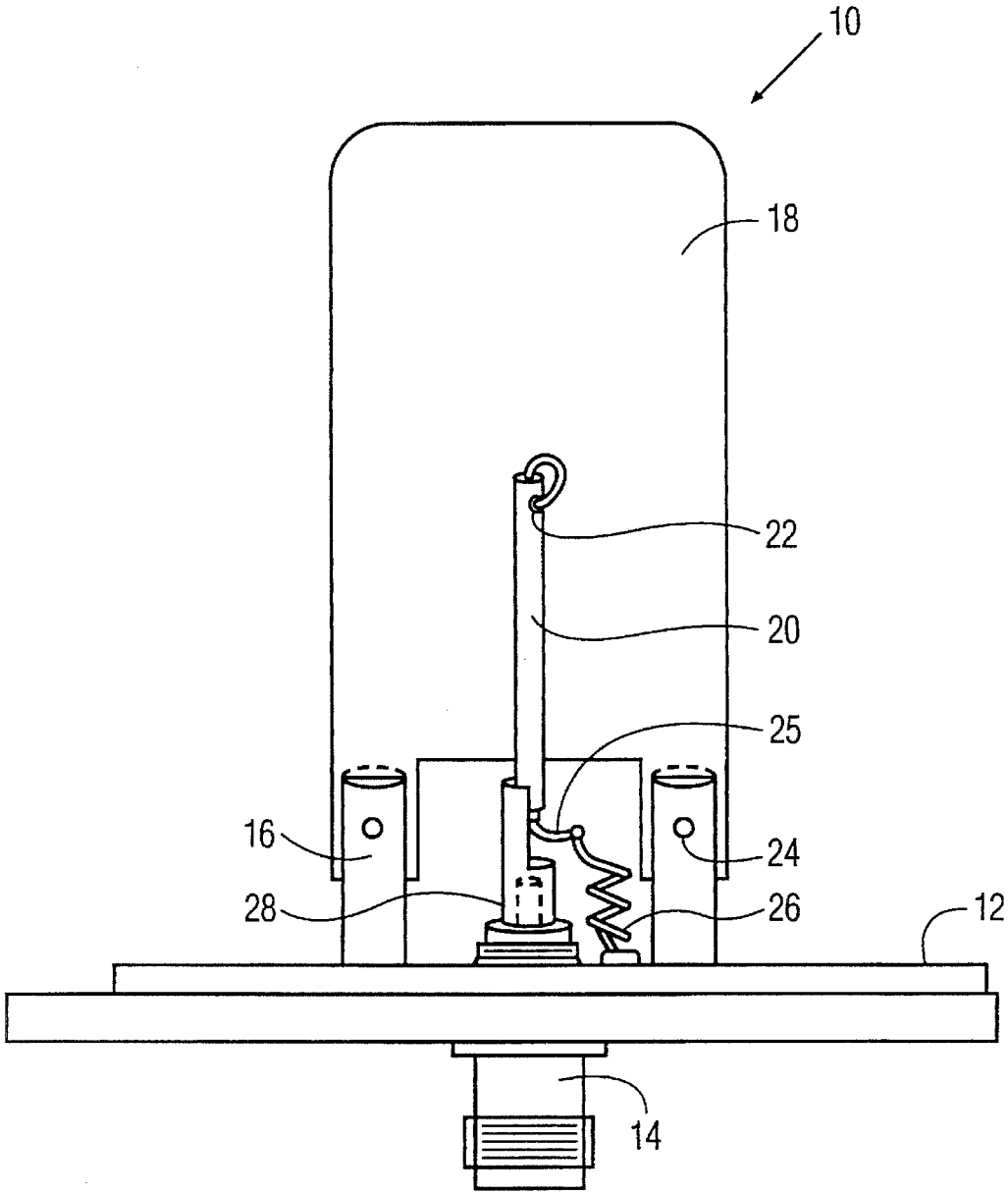
FIG. 1 is a side view schematic representation of one embodiment of the invention.
Figure 2:
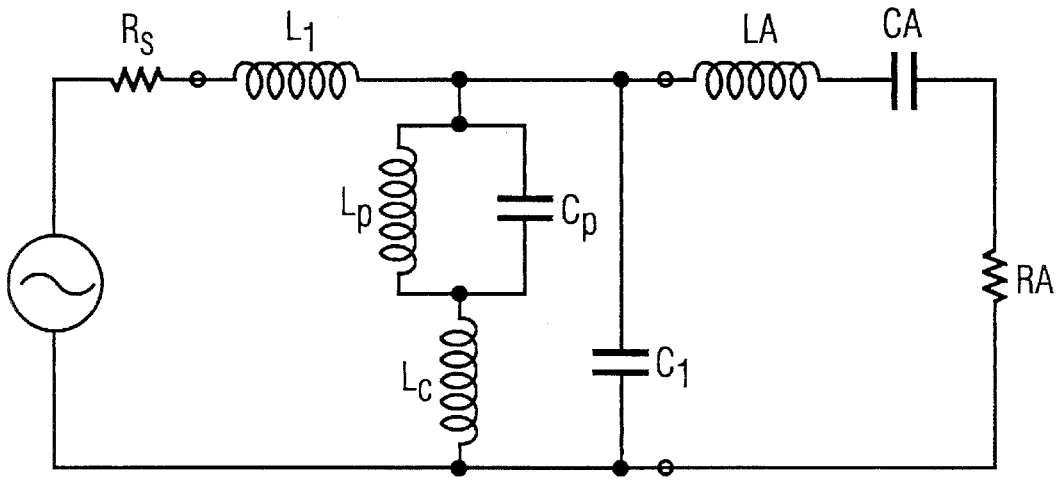
FIG. 2 is a schematic of the circuit elements of the embodiment of FIG. 1.

Referring to FIGS. 1 and 2, there is shown a radiating monopole blade antenna comprising base plate 12 through which input connector 14 mounts in a standard manner. Upstanding metallic blade radiator 18, generally oriented in a plane perpendicular to and lying along the axis of plate 12, mounts above by dielectric standoffs 16 and metal fastening pins 24. Members 16 may be screwed or otherwise secured to plate 12.

The outer jacket of stub 20 is bonded to one face of blade 18 generally as shown with its base end extending below the profile of the blade. The outer conductor jacket of stub 20 is electrically connected or soldered to hollow brass cylindrical adapter 28 which is electrically connected to the input connector center pin. The center conductor of stub 20 is coupled to plate 12 by a series choke coiled wire or air core inductor 26, functional at the operating frequency. The stub center conductor 25 is electrically bonded to the top coiled portion of wire 26 which in turn is connected to plate 12. The other end of the stub 20 has the center conductor shorted to the blade 18 at solder point 22.

The elements of the antenna forming the approximate equivalent circuit shown in FIG. 2 are:

$R_s$=RF source resistance (typically 50 or 75 Ohms or a complex impedance value)

$L_1$=Stub 20 outer shield inductance $C_P$=Distributed capacitance of stub 20

$L_P$=Distributed inductance of stub 20

$L_C$=Inductance of lumped choke inductor $C_1$=Distributed capacitance between plate 12 and blade 18.

$L_A$, $C_A$, $R_A$=Distributed intrinsic radiation resistance and reactance values of antenna radiator blade 18 approximate equivalent circuit As mentioned above, one embodiment can comprise a blade dimensioned to be electrically equivalent to ⅝ths of a wavelength at the desired center frequency of operation and stub 20 dimensioned to ¼ of an electrical wavelength, at center frequency, taking into account the phase velocity characteristics of coaxial cables with dielectric materials other than air. Spacing between blade 18 and plate 12 is selected so that $C_1$ is adjusted to a value proportional to the gap between them to provide the best overall antenna impedance matching characteristics.

In operation, stub 20 functions as a separate radiator driving element or feed line as well as a shunt stub at the desired center frequency. Note $L_P$, and $L_C$ provide a DC path to ground to bleed-off any static charge build-up and to assist in avoiding lightning strikes. The response curve of this system has a single notch in the VSWR response curve, unlike the second order Chebychev impedance stub matching scheme frequently employed in numerous antennas.

Figure 3:
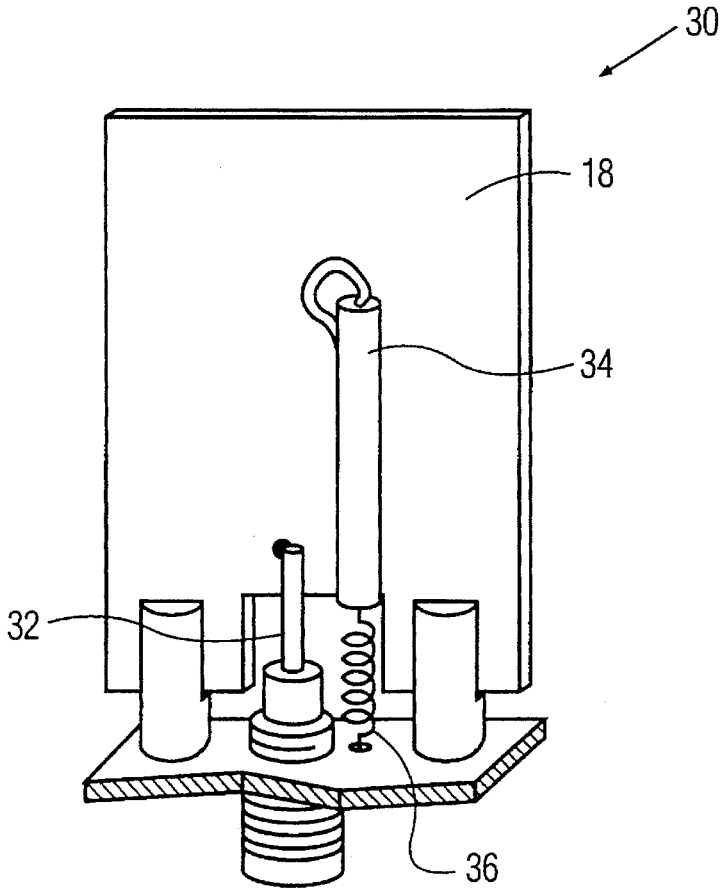
FIG. 3 is similar to FIG. 1 showing an alternate embodiment of the invention.
Figure 4:
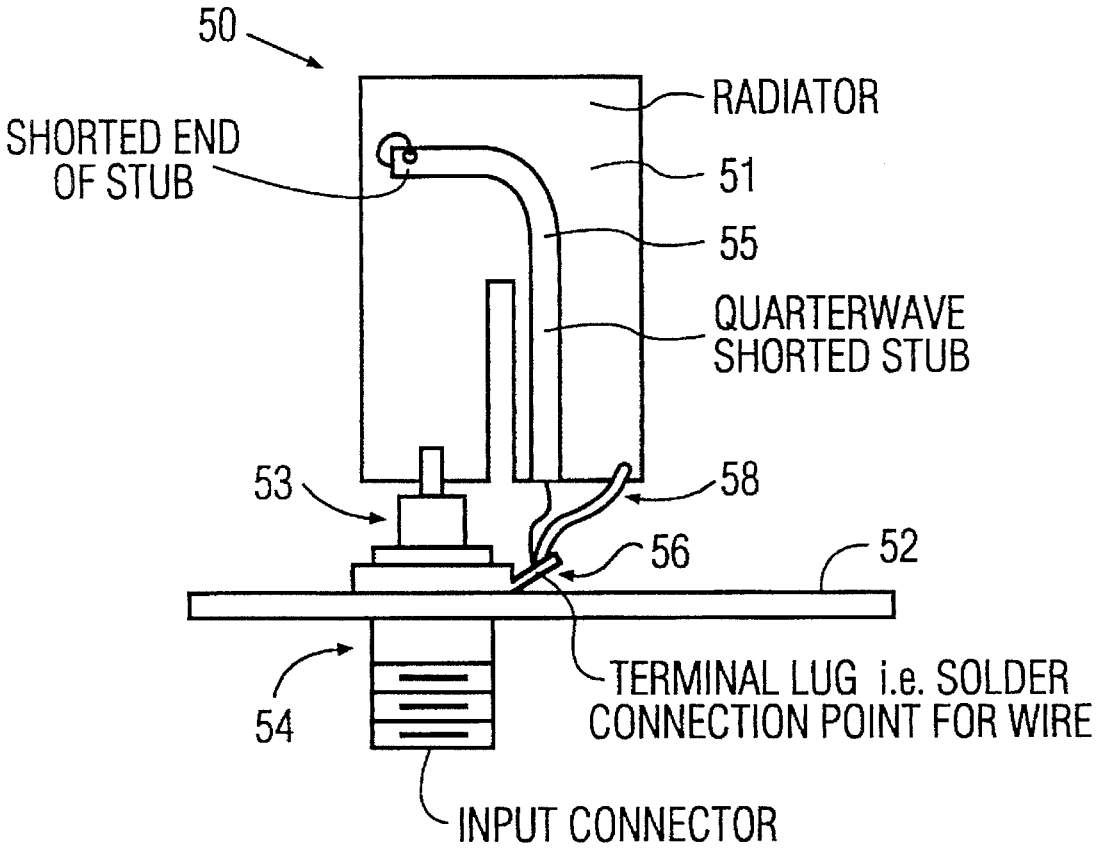
FIG. 4 PRIOR ART
FIGS. 4 and 5 depict known radiating blade antennas described above.
Figure 5:
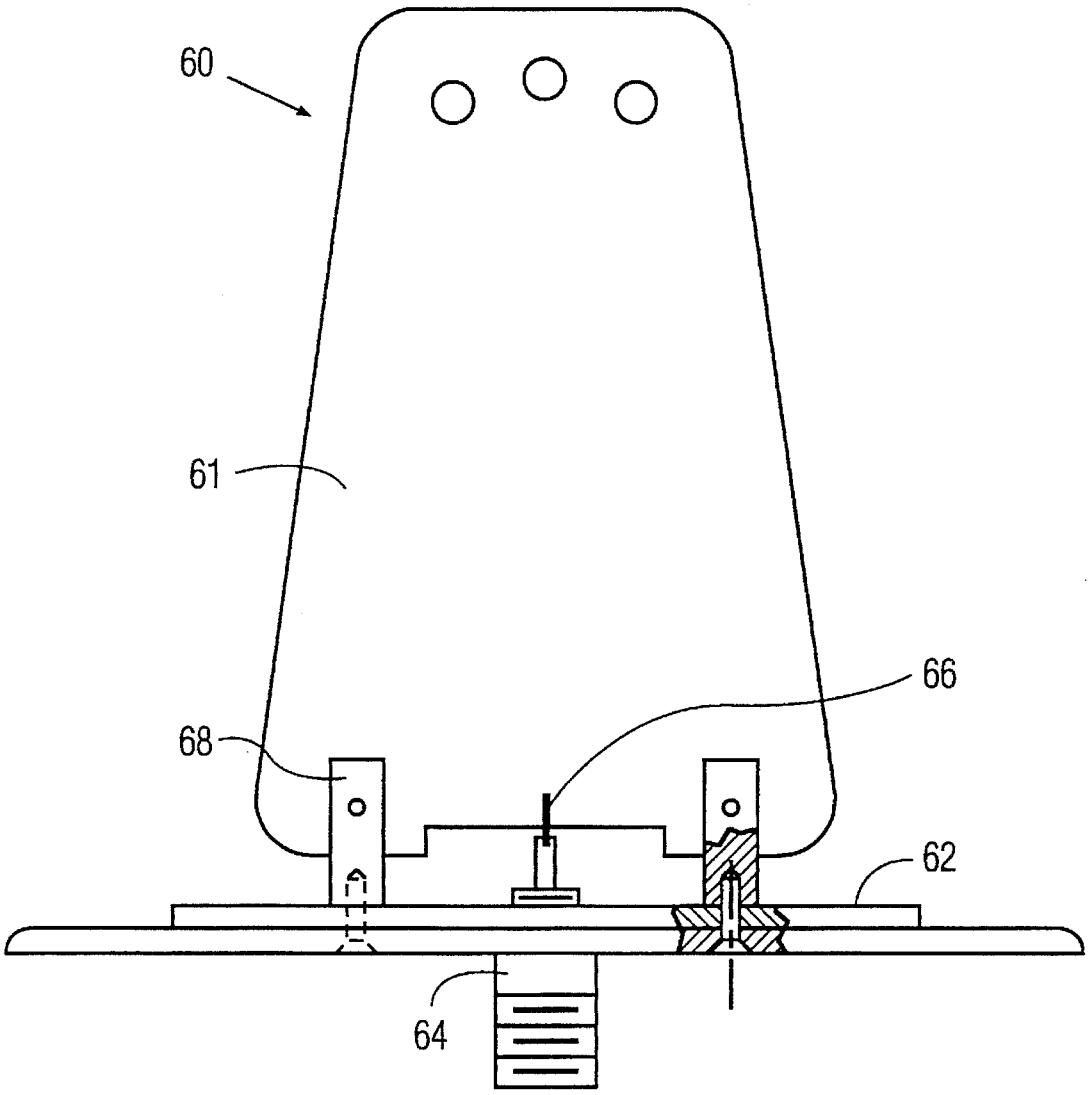
FIG. 5 PRIOR ART

An alternate embodiment according to the invention is shown in FIG. 3 which comprises antenna 30 in which stub 34 is off-set from alignment with the input connector. The outer shield of stub 34 open end is approximately aligned coincident with the edge of blade 18 open slot. Input wire 32 connects directly to the center line of the bottom part of blade 18 and is slightly spaced from the jacket of stub 34. An air-core inductor 36 couples the inner conductor of stub 34 to the base plate. The schematic circuit of this embodiment is the same shown in FIG. 2, the intrinsic inductance of wire 32 comprising $L_1$.

Function and operation of this embodiment is substantially similar to that of the first mentioned embodiment.

Antenna assembly is preferably packaged in a dielectric (plastic, foam, fiberglass, or other non-electrically conductive material) radome structure (not shown) for mechanical strength and aerodynamic considerations. Induced dielectric material frequency shifts caused by the radome can be compensated for by adjusting antenna radiator/tuning network dimensions.

It will be understood that other and further modifications can be made to the herein disclosed embodiments without departing from the spirit and scope of the present invention.

I claim:

1. A monopole radiating antenna configured for a predetermined center frequency and having a predetermined desired radiation impedance and an input connector, said antenna comprising, a base plate, an upstanding metallic radiator blade mounted above said plate, driving element means mounted to one face of said blade, a high impedance coaxial cable stub extending upwardly on said plate and extending along a lower portion of the vertical dimension of the blade, and said coaxial cable stub including a center conductor and an outer conductor iacket, and an inductor for electrically coupling said center conductor to said plate.

2. An antenna according to claim 1 wherein the center conductor of said stub extends beyond the upper end of the outer jacket of said stub and is electrically connected to said jacket.

3. An antenna according to claim 2, wherein said driving element means comprising an input connector mounted to the plate with the input conductor extending upward and electrically connected to the plate, and wherein said stub is spaced from said input conductor in a direction generally parallel to said blade.

4. An antenna according to claim 3, wherein said input conductor extends generally along the vertical center axis of the blade.

5. An antenna according to claim 4, wherein the portion of the blade nearer the plate includes a recess formed by parts of the blade extending toward the plate and the end of the stub is aligned generally with the upper-most edge of the recess.

6. An antenna according to claim 2, wherein said inductor comprises an aircoil.

7. An antenna according to claim 2, wherein the blade is aligned along the horizontal axis of the plate and dielectric standoff mounts support the blade on the plate.

8. An antenna according to claim 2 wherein said stub has a generally straight center axis.

9. A monopole radiating antenna configured for a predetermined center frequency and having a predetermined desired radiation impedance and an input connector, said antenna comprising, a base plate, an upstanding metallic radiator blade mounted above said plate, driving element means mounted to one face of said blade for providing radiating energy to said blade, and wherein a high impedance coaxial cable stub extending upwardly on said plate and extending along a lower portion of the vertical dimension of the blade, said stub comprising a center conductor and an outer conductor jacket, and wherein said center conductor of said stub extends beyond the upper end of the outer jacket of said stub and is electrically connected to said jacket, and wherein the other end of said stub is positioned above said plate and said center conductor of said stub extends beyond said other stub end and is electrically coupled to said plate, and wherein the portion of said blade nearer the plate includes a recess formed between two parts extending toward the plate, and wherein the lower portion of said stub extends into the recess.

10. An antenna according to claim 9, wherein conductive means electrically connects a lower portion of said stub outer conductor jacket to the plate.

11. An antenna according to claim 10, wherein an input connector is provided for connection through said plate, and wherein said stub and conductive means are formed in elongated cylinders, and wherein said input connector, stub, and conductive means are generally axially aligned and said blade is generally symmetrically arranged with respect to said stub.

12. An antenna according to claim 11, wherein said blade is dimensioned to five-eighths of the desired center frequency wavelength.

13. An antenna according to claim 12, wherein the length of said stub is selected so that its inductance is one-quarter of the wavelength of the center frequency.

14. A monopole radiating antenna configured for a predetermined center frequency and having a predetermined desired radiation impedance, said antenna comprising, a base plate, and an input connector mounted through said base plate and having an input center conductor an upstanding metallic radiator blade mounted above said plate, a high impedance coaxial cable stub extending upwardly on said plate and extending along a lower portion of the vertical dimension of the blade, and said coaxial cable stub including a center conductor and an outer conductor jacket, and an inductor for electrically coupling said center conductor to said plate, and a driving element comprising a metal tubular member for coupling input signals from said input center conductor to said outer conductor jacket.

* * * * *